US007274884B2

(12) United States Patent
Yamauchi

(10) Patent No.: US 7,274,884 B2
(45) Date of Patent: Sep. 25, 2007

(54) IMAGE FORMING APPARATUS TO WHICH A CARTRIDGE HAVING A MEMORY MEDIUM CONFIGURED TO STORE INFORMATION-FORMING-CONDITION INFORMATION IS ATTACHABLE, SUCH A CARTRIDGE, SUCH A MEMORY MEDIUM, AND AN IMAGE FORMING SYSTEM COMPRISING SUCH A MEMORY MEDIUM

(75) Inventor: Kazumi Yamauchi, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 277 days.

(21) Appl. No.: 10/702,658

(22) Filed: Nov. 7, 2003

(65) Prior Publication Data

US 2004/0131370 A1 Jul. 8, 2004

(30) Foreign Application Priority Data

Nov. 8, 2002 (JP) ..... 2002-325797
Oct. 30, 2003 (JP) ..... 2003-370552

(51) Int. Cl.
*G03G 15/08* (2006.01)

(52) U.S. Cl. ..... 399/25; 399/26; 399/27

(58) Field of Classification Search ..... 399/24, 399/25, 26, 27
See application file for complete search history.

(56) References Cited

U.S. PATENT DOCUMENTS 5,272,503 A 12/1993 LeSueur et al. ..... 355/208
5,626,997 A 5/1997 Mashimo et al. ..... 430/55
6,549,223 B2 4/2003 Yamauchi ..... 347/132
6,654,568 B2 * 11/2003 Matsuguma ..... 399/24
2002/0021914 A1 2/2002 Serizawa ..... 399/75
2002/0025176 A1 2/2002 Sakurai et al. ..... 399/25
2002/0057916 A1 * 5/2002 Yamauchi ..... 399/24

FOREIGN PATENT DOCUMENTS

JP 7-244419 9/1995
JP 2001-117425 4/2001
JP 2001-117468 4/2001

OTHER PUBLICATIONS

Machine translation of JP 2001-117425.*

* cited by examiner

*Primary Examiner*—David M. Gray
*Assistant Examiner*—Ruth N. LaBombard
(74) *Attorney, Agent, or Firm*—Fitzpatrick, Cella, Harper & Scinto

(57) ABSTRACT

An image forming apparatus to which a cartridge is mountable and which is operable to form images at different image formation speeds, wherein the cartridge includes a memory medium having a memory area for storing information relating to image forming conditions of process means corresponding to the image formation speeds, the image forming apparatus includes a control unit for setting the image forming conditions, wherein the control unit sets an image forming condition corresponding to the image formation speed on the basis of the image forming condition of the process means responding to the image formation speed.

12 Claims, 8 Drawing Sheets

IMAGE FORMING APPARATUS TO WHICH A CARTRIDGE HAVING A MEMORY MEDIUM CONFIGURED TO STORE INFORMATION-FORMING-CONDITION INFORMATION IS ATTACHABLE, SUCH A CARTRIDGE, SUCH A MEMORY MEDIUM, AND AN IMAGE FORMING SYSTEM COMPRISING SUCH A MEMORY MEDIUM

FIELD OF THE INVENTION AND RELATED ART

The present invention relates to: an image forming apparatus such as a laser beam printer, a copying machine, a facsimile machine, etc., which employs an electrophotographic image forming method; a process cartridge mountable in the image forming apparatus; an image formation system for forming an image on recording medium with the use of the process cartridge; and a storage medium mountable in the process cartridge.

In an electrophotographic image forming apparatus such as a copying machine or a laser beam printer, an image is formed through the following steps. That is, a beam of light is projected, while being modulated with image formation information, onto the electrophotographic photoconductive member, forming a latent image thereon, and the latent image is developed into a visual image by supplying the latent image with developer (toner) as recording material, by a developing means. Then, the visual image is transferred from the photoconductive member onto recording medium such as a piece of recording paper.

For the simplification of maintenance, more specifically, in order to make it easier to replace a photoconductive drum, or replenish an image forming apparatus with a consumable such as toner, some of the image forming apparatuses of the above described type are structured to be compatible with a process cartridge, in which the combination of a toner storage and a developing means, a photoconductive member, a charging means, and a cleaning means inclusive of a waste toner storage (container), etc., are integrally disposed, and which is removably mountable in the main assembly of an image forming apparatus. In the case of such an image forming apparatus as a color image forming apparatus having a plurality of developing means, each developing means may be different in the rate of wear from the other, and in addition, the rates at which the photoconductive drums wear may be different from the rates at which the developing means wear. Thus, as a means for dealing with these problems, various process cartridges are created; for example, development cartridges, photoconductive drum cartridges, etc. In the case of the development cartridges, they are made different in the color in which they develop a latent image. In the case of the photoconductive drum cartridges, they comprise the combination of a cleaning means and a photoconductive drum.

Here, a process cartridge is a cartridge in which an electrophotographic photoconductive member, and a minimum of one processing means among a charging means, a developing means, and a cleaning means, are integrally disposed, and which is removably mountable in the main assembly of an image forming apparatus. It also refers to a cartridge in which a minimum of a charging means and an electrophotographic photoconductive member are integrally disposed, and which is removably mountable in the main assembly of an image forming apparatus.

Further, some process cartridges are provided with a storage means (memory) in order to manage the information regarding them. For example, in the case of a process cartridge disclosed in U.S. Pat. No. 5,272,503, the amount of the cumulative cartridge usage is stored in the memory to alter the operational setting according to the amount of the cumulative cartridge usage; the amount of charge current is switched, or the amount of exposure light is adjusted. In the case of these process cartridges, they are controlled in the same manner, despite their differences, as long as they are the same in the amount of cumulative usage.

In the case of Japanese Laid-open Patent Application 2001-117425 or 2001-117468, in order to extend the service life of the photoconductive drum of each process cartridge while maintaining image quality at a preferable level, the amount of the charge current to flow in the process cartridge, and the amount of the development voltage, are switched according to the information stored in the storage medium of the cartridge; the amount of the charge current is switched to the minimum value necessary to keep image quality at a preferable level.

However, the effect of the amount of process cartridge usage upon the quality with which an image is formed, is affected by performance factors, such as process speed and/or throughput, of an image forming apparatus. Thus, if two image formation systems, which are changeable in performance factors such as process speed or throughput, and are identical in structural configuration, are used for the same length of time, the two apparatus become different in image quality, because there is virtually no possibility that the two apparatus remain the same in process speed and/or throughput. Therefore, it was impossible in the past to assure that the quality with which an image is formed by an image forming apparatus would not be affected by the condition in which the image forming apparatus is operated.

SUMMARY OF THE INVENTION

The present invention was made to solve the above described problems, and its primary object is to provide a combination of an image forming apparatus, a process cartridge, an image formation system, and a memory for the cartridge, which makes it possible to reliably form an image of preferable quality.

Another object of the present invention is to provide a combination of an image forming apparatus with two or more image formation speeds, a process cartridge, an image formation system, and a memory for the cartridge, which makes it possible to compensate for the effect of the cartridge usage, which is affected by the image formation speed, in order to always form an image of preferable quality, regardless the image formation speed.

Another object of the present invention is to provide a combination of an image forming apparatus, a process cartridge, an image formation system, and a memory for the cartridge, which stores in the memory, two or more sets of data (one set for each of the performance factors), more specifically, the cumulative amount of cartridge usage, thresholds for the cumulative amount of cartridge usage, and data to be used for switching the processing condition as the cumulative amount of cartridge usage reaches one of the thresholds, in order to make it possible to compensate for the effect of the cartridge usage, which is affected by the performance factors of an image forming apparatus, in order to always form an image of preferable quality.

According to one of the aspects of the present invention, an image forming apparatus in which a cartridge comprising an image bearing member and a charging member for charging the image bearing member is removably mountable, and which is provided with two or more image formation speeds, is characterized in that:

the cartridge it employs is provided with: a storage medium having a first storage region for storing, per image formation speed, a set of data for specifying the processing condition; and a control unit for setting the image formation condition, and;

that the control unit sets the image formation condition, which matches the image formation speed, based on the aforementioned set of data for specifying the processing condition.

According to another aspect of the present invention, a cartridge, which is removably mountable in the main assembly of an image forming apparatus capable of forming an image at two or more performance settings, and which has portions which share the image formation process with the main assembly of the image forming apparatus, and a storage medium, is characterized in that:

the storage medium has a first storage region for storing, per image formation speed, a set of data for specifying the processing condition; and a control unit for setting the image formation condition.

According to another aspect of the present invention, a storage medium mountable in a cartridge which is removably mountable in the image assembly of an image forming apparatus capable of forming an image at two or more performance settings, and which has the portions which share the image formation process with the main assembly, is characterized in that it has a first storage region for storing, per image formation speed, a set of data for specifying the processing condition.

According to another aspect of the present invention, an image formation system comprising a main assembly and a cartridge and capable of forming an image at two or more performance settings, is characterized in that:

it further comprises:

portions for carrying out a part of the image formation process;

a storage medium mounted in the cartridge and having a first storage region for storing, per image formation speed, a set of data for specifying the image forming condition in which the portion for carrying out a part of the image forming process operates; and a control unit for specifying the image formation condition; and that the control unit sets the image formation condition, which matches the image formation speed, based on the data regarding the image formation condition for the portion for carrying out a part of the image formation process.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, process cartridges, image forming apparatuses or image formation systems, in which a single or plurality of process cartridges are removably mountable, and memories mountable in a process cartridge, in accordance with the present invention, will be described in more detail with reference to the appended drawings.

Embodiment 1

Figure 2:
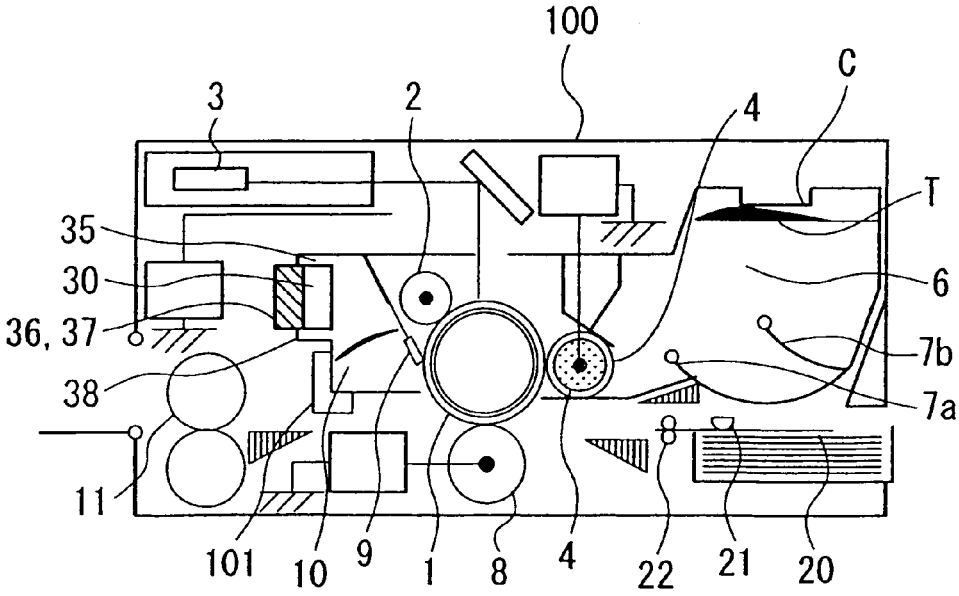
FIG. 2 is a sectional view of the image forming apparatus which employs a process cartridge, in the first embodiment of the present invention.

First, referring to FIG. 2, an example of an electrophotographic image forming apparatus in which a process cartridge structured in accordance with the present invention is mountable will be described. The image forming apparatus in this embodiment is a laser beam printer which outputs an image by receiving image formation information from a host computer, and in which a process cartridge is removably mountable in order to replace the photoconductive member in the form of a drum, that is, a photoconductive drum, having expired in service life, with a brand-new one, or to replenish the image forming apparatus with consumables such as developer. First, the image forming apparatus and process cartridge in this embodiment will be described with reference to FIG. 2.

The process cartridge C in this embodiment comprises a plurality of components as elements for carrying out the image formation process for the image forming apparatus in this embodiment. More specifically, the process cartridge C comprises: a housing (cartridge shell), and a plurality of processing means integrally disposed in the housing. The processing means are: a photoconductive drum 1, that is, a photoconductive member in the form of a drum; a contact type charging roller 2 for uniformly charging the photoconductive drum 1; a development sleeve 4 as a developing means disposed in parallel to the photoconductive drum 1 so that its peripheral surface is positioned virtually in contact with the peripheral surface of the photoconductive drum 1; and a cleaning blade 9 as a cleaning means; etc. The housing comprises: a developer storage portion (developer container) 6 which rotatably supports the development sleeve 4 and contains developer T; and a waste toner holding portion (waste toner container) 10 in which the residual toner is stored after it is removed from the photoconductive drum 1 by the cleaning blade 9. The process cartridge C is removably mountable in the mounting means 101 of an image forming apparatus, by a user.

The development sleeve 4 of the developing means is a nonmagnetic sleeve with a diameter of 20 mm. It comprises an aluminum cylinder, and a resinous layer formed on the peripheral surface of the aluminum cylinder by coating on the peripheral surface of the aluminum cylinder a resinous material which contains electrically conductive particles. In the hollow of the development sleeve 4, a magnetic roll with four magnetic poles is disposed, although it is not shown. The developer regulating member in this embodiment is a piece of urethane rubber with a hardness of roughly 65° (JIS), and is attached to the developer container 6, being kept in contact with the development sleeve 4 so that the contact pressure between the developer regulating member and development sleeve 4 remains in the range of 25-35 gf/cm (contact pressure per 1 cm in terms of lengthwise direction of development sleeve 4).

In this embodiment, the developer T stored in the developer storage portion (container) 6 is a single-component magnetic toner having a negative inherent electrical polarity (which hereinafter will be simply referred to as toner). The ingredients of the toner are bonding resin, the main ingredient of which is polyester resin and a magnetic substance, which in this embodiment is iron oxide. The iron oxide in this embodiment contains 0.1-2.0 weight percent of Si, and 0.10-4.00 weight percent of Zn. In production, these ingredients are mixed, melted, and cooled. Then, the cooled mixture is pulverized with a mechanical pulverizer, while adjusting the temperature to surface treat the resultant particles. Then, the resultant particles are sorted with air flow, obtaining such developer that is 5.0 μm in weight average diameter. Then, the developer with a weight average diameter of 5.0 μm is mixed with 1.3 parts in mass of silica, that is, a hydrophobic substance, in the form of minute particles, and 1.0 part in mass of strontium titanate, obtaining the developer T, the weight average particle diameter of which is in the range of 5.0-7.0 μm (roughly 6 μm).

When the gap between the photoconductive drum 1 and development sleeve 4 is, for example, roughly 300 μm, the development bias applied to the development sleeve 4 is the combination of a DC voltage of −550-−400 V, and an AC voltage which is rectangular in waveform, 1,600 V in peak-to-peak voltage, and 2,600 Hz in frequency.

There are toner stirring means 7*a* and 7*b* in the developer storage portion, that is, the toner container 6. The toner stirring means 7*a* and 7*b* rotate twice every three seconds, and once every second, respectively, sending toner into the development range while loosening the toner T in the toner container 6.

The charge roller 2 comprises a metallic core, and a layer of electrically conductive elastic material formed on the peripheral surface of the metallic core. It is rotatably supported by the lengthwise end portions of the metallic core, being kept in contact with the peripheral surface of the photoconductive drum 1 so that a predetermined amount of contact pressure is maintained between the peripheral surface of the photoconductive drum 1 and charge roller 2. It is rotated by the rotation of the photoconductive drum 1.

To the charge roller 2, the combination (Vac +Vdc) of an AC component Vac and a DC component Vdc is applied from the high voltage power source in an image forming apparatus 100, through the metallic core. As the result, the peripheral surface of the photoconductive drum 1, which is being rotationally driven, is uniformly charged by the charge roller 2. In terms of peak-to-peak voltage, the AC component Vac is twice the threshold voltage for charging the photoconductive drum 1.

More specifically, the charge bias applied to the charge roller 2 is the combination of a DC voltage in the range of −720 -−520 V, and an AC voltage which is rectangular in waveform, 2,500 Hz in frequency, and 1,900 μA in effective current value. As a result, the peripheral surface of the photoconductive drum 1 is charged to a potential level Vd in the range of −700 -−500 V. The DC voltage is kept constant in voltage level, whereas the AC voltage is applied in such a manner that the current value remains constant. As a given point of the charged portion of the peripheral surface of the photoconductive drum 1 is exposed to a beam of laser light for exposure, the potential level VL of this point is reduced to −200 -−100 V, and this point (with potential level of VL) is developed in reverse.

The cylindrical photoconductive drum 1 as a member for bearing a latent image is rotated about its axle supported by the main assembly of the image forming apparatus 100. The image forming apparatus 100 in this embodiment is provided with two process speeds (V), that is, the speeds at which a given point of the peripheral surface of a photoconductive drum moves. More specifically, it can be rotationally driven at 270 mm/sec (Va) or 135 mm/sec (Vb).

After a given portion of the peripheral surface of the photoconductive drum 1 is uniformly charged by the charge roller 2, a latent image is formed on this portion by an exposing apparatus 3. Then, this portion of the peripheral surface of the photoconductive drum 1, across which the latent image having just been formed, is supplied with the developer T, by the development sleeve 4 which is an essential part of the developing apparatus. As a result, the latent image is developed into a visible image. The development sleeve 4 is connected to a bias supplying power source (unshown) which applies the combination of a DC bias and an AC bias between the photoconductive drum 1 and development sleeve 4, so that a proper development bias is applied between the photoconductive drum 1 and development sleeve 4.

The toner image on the photoconductive drum 1, that is, the image formed on the photoconductive drum 1 by visualizing the latent image with the use of the toner T through the above described steps, is transferred onto a recording medium 20, for example, a piece of recording paper, by a transfer roller 8. The recording medium 20 is fed into the main assembly of the image forming apparatus 100 by a feed roller 21, and is sent to the transfer roller 8 while its movement is synchronized with that of the toner image on the photoconductive drum 1 by a registration roller 22 and a top sensor. Then, the toner image, or an image formed of the toner T, is transferred onto the recording medium 20, and is sent, together with the recording medium 2, to a fixing apparatus 11. In the fixing apparatus 11, the toner image on the recording medium 20 is fixed to the recording medium 20 with the application of heat and/or pressure, turning into a permanent image. Meanwhile the portion of the toner T which remained on the photoconductive drum 1, that is, the portion of the toner T, which was not transferred, is removed by a cleaning blade 9, and is stored in the waste toner container 10. Thereafter, the portion of the peripheral surface of the photoconductive drum 1, from which the residual portion of the toner T has been removed, is charged again by the charging apparatus 2, and is subjected again to the above described steps.

Next, the storage medium, that is, the memory, for a process cartridge mountable in the above described process cartridge, will be described.

In the case of this embodiment, the cartridge C is provided with a memory 30, and a transmitting means 35 which comes into contact with the reading means 36 and writing means 37 of the main assembly of the image forming apparatus, at a predetermined location, and transmits the information in the memory 30, to a CPU as a controlling means 40. The memory 30 and transmitting means 35 are on the one of the side walls of the waste toner container 10, so that when the cartridge C is in the proper position in the main assembly of the image forming apparatus 100, the transmitting means 35 of the cartridge C directly opposes the control portion reading means 36 and writing means 37 of the main assembly of the image forming apparatus 100. As for the choice of the storage medium usable as the memory 30 in this embodiment, any of the ordinary electronic memories based on semiconductor can be used with no specific restriction.

The reading means 36, writing means 37, and transmitting means 35 together constitute a controlling/transmitting portion 38 for reading the information in the memory 30, and writing information into the memory 30. The capacity of the memory 30 is to be large enough to store multiple sets of data, for example, the data regarding the usage of the cartridge C, which will be described later, values which specify the operational condition of the image forming apparatus, etc.

According to the present invention, one of the data written into the memory 30 and stored therein is the amount by which the cartridge C has been used. There is no specific restriction regarding the terms in which the amount of the cartridge usage is expressed. For example, it may be the length of time each unit in the cartridge C has been used, the length of time a bias has been applied, the amount of the remaining toner, the print count, the cumulative number of dots having been formed on the photoconductive drum 1, the cumulative length of time the laser has been fired to expose the photoconductive drum 1, the thickness of the photo conductive layer of the photoconductive drum 1, values obtained by combining, while weighting, the values of two or more factors among the preceding factors, etc.

Also to be stored in the memory 30 are the thresholds to be compared with the cumulative amount the cartridge C has been used, and the values to which the operational specifications set as the cumulative amount of the cartridge usage reaches one of the thresholds. These data are stored in advance in the memory when a process cartridge is shipped out of a factory, or on the like occasion. The thresholds are the data related to the timing with which the operational setting are switched. In other words, they are values of the length of time each unit in the cartridge C has been used, the length of time that the bias has been applied, the amount of the remaining toner, the print count, the cumulative number of dots having been formed on the photoconductive drum 1, the cumulative length of time that the laser has been fired to expose the photoconductive drum 1, the thickness of the photoconductive layer of the photoconductive drum 1, and values obtained by combining, while weighting, the values of two or more factors among the preceding factors, etc., are compared, in order to switch the preset values for the operational specifications.

The data, based on which the operational specifications are switched, are transmitted to the controlling means, and the controlling means transmits signals, which match the data, to the processing units, setting the operational specifications (values) for the processing units. More specifically, the operational factors, for which specific values are to be set, are the DC voltage as a part of the charge bias, the AC voltage as a part of the charge bias, the DC voltage as a part of the development bias, the amount by which the photoconductive drum 1 is exposed by the exposing means, etc.

The thresholds with which the cumulative amount of the cartridge usage is compared, and the data for specifying the operational settings, are such values that match the properties of the cartridge. They are decided based on cartridge capacity, types of a photoconductive drum, toner, and a charge roller, production lot numbers of a photoconductive drum, toner, and a charge roller, and the like factors.

The sets of data, based on which the operational specifications for the image forming apparatus are set, are individually stored in the two or more storage regions of the memory, one for one. More specifically, the operational specifications are the throughput and the process speed of the image forming apparatus. Here, throughput means the number of prints which can be produced per unit of time, and the process speed is the rotational speed of a photoconductive drum.

In the case of the embodiment of the present invention, which will be described hereafter, two sets of data which specify the operational specifications of an image forming apparatus are prepared for the aforementioned two process speeds Va and Vb, one for one, and are stored in the memory.

Next, the operational specifications for the image forming apparatus in this embodiment will be described.

The image forming apparatus in this embodiment has the aforementioned two process speeds Va and Vb. The process speed Va is faster than the process speed Vb ($Va=2\times Vb$). The image forming apparatus is set up so that the process speed can be switched by a user through the unshown control panel of the image forming apparatus. The image forming apparatus may be set up so that a command can be transmitted from a host computer, or the like, connected to the image forming apparatus, to switch the process speed.

Figure 3:
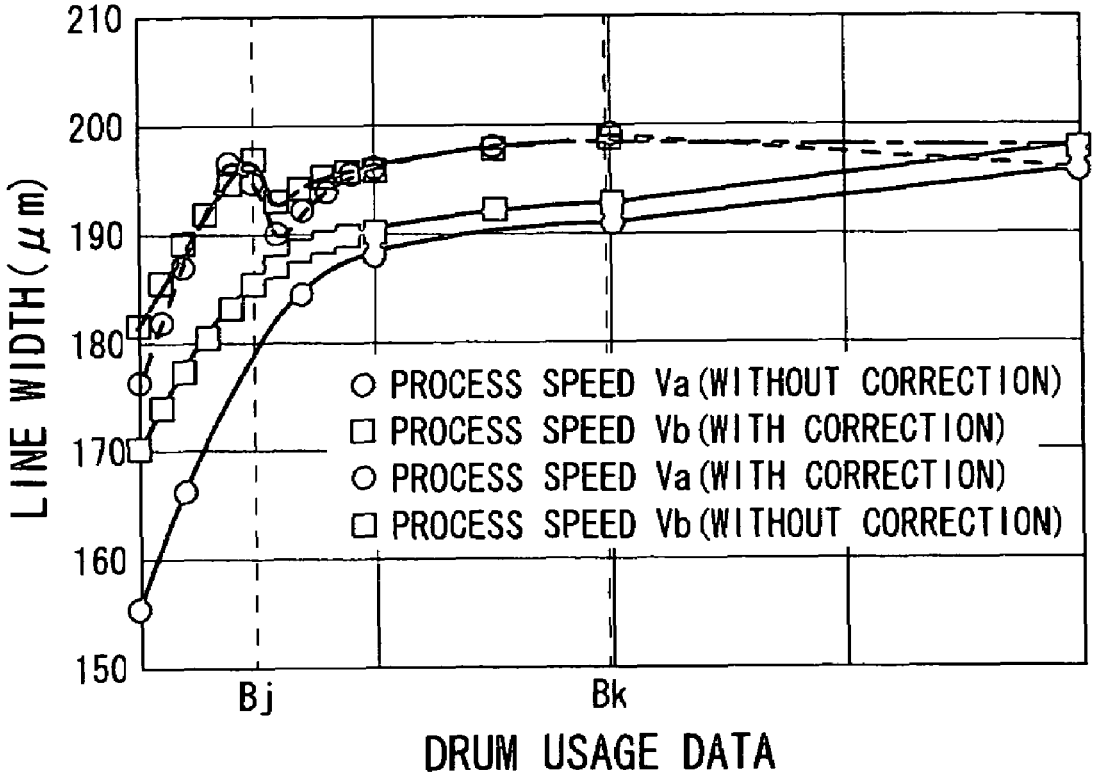
FIG. 3 is a graph showing the relationship between the data regarding drum usage and the line width, in the first embodiment of the present invention.

It has been known that changing the process speed of an image forming apparatus affects the properties of the image which the apparatus forms; more specifically, the line width which reflects the amount of the cartridge usage is affected by the process speed. FIG. 3 shows the relationship between the width of a line (four dots×six spaces) formed at 600 dpi, and the process speed (process speeds Va and Vb). It is evident from this graph that the higher the process speed, the narrower the line width. What is presumed as one of the causes of this phenomenon is that the higher the process speed, the shorter the time it takes for a latent image on a photoconductive drum to pass through the development nip (region in which distance between peripheral surfaces of photoconductive drum and development sleeve is smallest), and therefore, the smaller the amount by which the toner particles on the development sleeve scatter. It is presumed as another cause of the above described phenomenon that the higher the process speed, the shorter the time it takes for the toner particles on the development sleeve to pass through the contact area between the development blade and development sleeve, and therefore, the less likely the toner particles are to be charged.

Thus, in this embodiment, as the cumulative amount A of a photoconductive drum usage reaches the threshold stored in the memory, the following steps are taken in the listed order to switch the DC voltage as a part of the charge bias, and the DC voltage as a part of the development bias:

(1) The amount A of the usage of the photoconductive drum, in the memory, is read.

(2) The amount A read from the memory is compared with the threshold in the memory.

(3) The data for specifying the value for the DC voltage as a part of the charge bias, and the value for the DC voltage as a part to the development bias, in accordance with the process speed, are selected.

(4) The length of time the AC voltage as a part of the charge bias is applied, and the length of time the photoconductive drum is rotated, are measured.

(5) Control signals are transmitted to the power source for applying the DC voltage as a part of the charge bias, and the power source for applying the DC voltage as a part of the development bias.

(6) The amount by which the photoconductive member was used during the immediately preceding image forming operation is obtained by adding the value obtained by weighting, with a coefficient, the measured length of time the photoconductive member was rotated, to the measured length of time the DC voltage as a part of the charge bias was applied.

(7) The amount A, that is, the amount reflective of the effect of the process speed, by which the photoconductive drum was used, is calculated using the arithmetic coefficient specific to each process speed, in order to take the effect of the process speed into consideration.

(8) The value obtained by adding the amount A, reflective of the effect of the process speed, by which the photoconductive member was used during the immediately preceding image forming operation, to the amount A, that is, the cumulative amount of the usage of the photoconductive member, read from the memory, is written, as the new value for the amount A, into the memory.

With the use of the above described steps, the DC component of the charge bias, and the DC component of the development bias can be switched as the cumulative amount of the drum usage reaches the threshold stored in the memory. Therefore, not only is it possible to keep the line width virtually stable regardless of process speed, but also, it is possible to reduce the extent to which a formed image suffers anomalies.

Next, referring to FIGS. 4 and 1, the setup, in this embodiment, for controlling the memory will be described.

Figure 4:
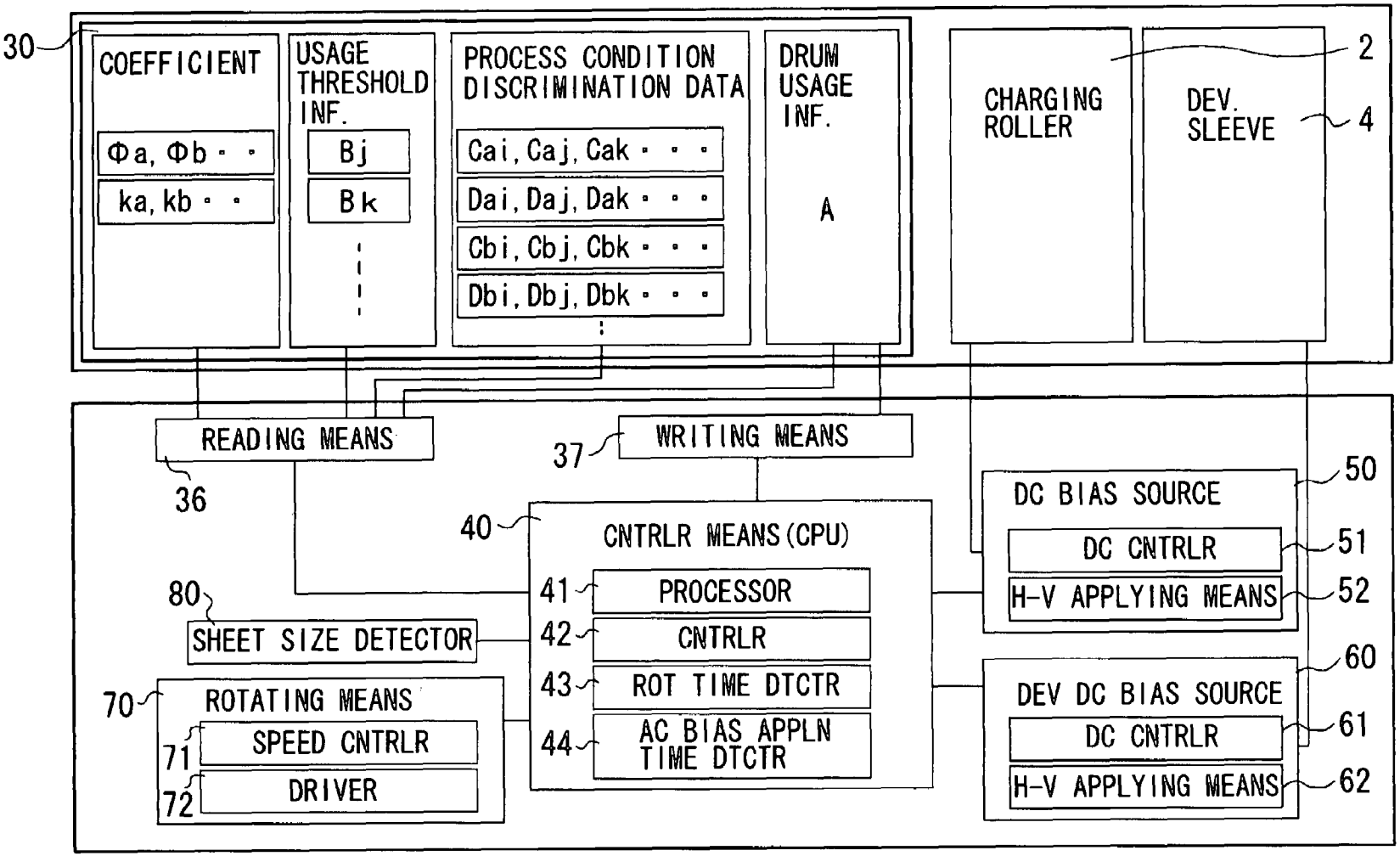
FIG. 4 is a block diagram showing the relationship between the control portion of the main assembly of the image forming apparatus, and the data (information) in the memory, in the first embodiment of the present invention.

Referring to FIG. 4, the cartridge C is provided with the memory 30, which is disposed so that when the cartridge C is in the proper position in the main assembly of the image forming apparatus, the memory 30 is in contact with the reading means 36 and writing means 37 of the main assembly. The controlling means 40, which is the CPU, is provided with a controlling portion processor 41, a controller 42, an arithmetic portion 43 for detecting the length of the duration of the photoconductive member rotation, a portion 44 for detecting the length of the duration of the charge bias application, etc. Although FIG. 4 shows a setup in which the reading means 36 and writing means 37 are separately disposed, the two means may be integrated into a single means capable of performing both the reading and writing functions.

The controlling means 40 is connected with a DC voltage power source 50 for charge bias application, a DC voltage power source 60 for development bias application, a means 70 for rotationally driving the photoconductive drum, and a means 80 for detecting recording medium sheet size.

The charge bias power source 50 has a portion 51 for controlling direct current, and a portion 52 for applying high voltage. The development bias power source 60 has a portion 61 for controlling direct current, and a portion 62 for applying high voltage. The direct current controlling portions 51 and 61 of both portions 50 and 60, respectively, are controlled by the control signals from the controlling means 40, to control the biases outputted to the charge roller 2 and development sleeve 4.

The means 70 for controlling the driving of the photoconductive member has a speed controlling portion 71 and a driving portion 72. The driving portion 72 is in the form of a motor (unshown), for example, and the speed controlling portion 71 is in the form of a motor driving circuit (unshown), for example. The photoconductive member driving means 70 controls, that is, changes or maintains, the performance factors, such as process speed, more specifically, the speed at which the photoconductive drum is driven, in response to the control signals from the controlling means 40.

The sheet size detecting means 80 is in the form of a sensor (unshown), for example, for detecting the size of the recording medium sheet. It detects the size of a recording medium sheet as the sheet is fed into the main assembly of an image forming apparatus, and transmits a signal which indicates the detected sheet size to the controlling means 40, which controls the image forming operation in response to the sheet size signal from the sheet size detecting means 80.

Figure 1:
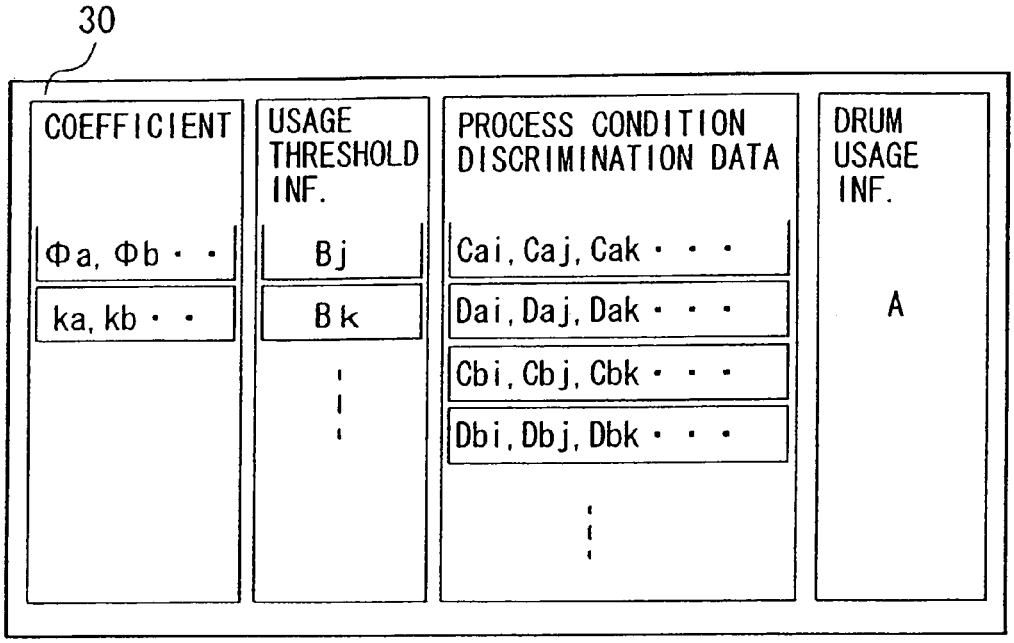
FIG. 1 is a block diagram showing the structure of the storage region in the memory in the first embodiment of the present invention.

Shown in FIG. 1 are multiple sets of data in the memory 30. There are various data stored in the memory 30. In the memory in this embodiment, at least, the amount A of photoconductive drum usage; coefficients ka and kb (weighting factors for the length of time the photoconductive member has been rotated) for the arithmetic formulae for calculating the amount of the drum usage; coefficients $\phi a$ and $\phi b$ (weighting factors for the process speed); thresholds Bj and Bk for the amount of photoconductive member usage; data Cai, Caj, and Cak (for the process speed Va) for specifying the value to which the DC component of the charge bias is to be set; thresholds Cbi, Cbj, and Cbk (for the process speed Vb) for specifying the value to which the level of the DC component of the charge bias is set; data Dai, Daj, and Dak (for the process speed Va) for specifying the value to which the level of the DC component of the development bias is set; and data Dbi, Dbj, and Dbk (for the process speed Vb) for specifying the value to which the level of the DC component of the development bias is set, are stored. The coefficients for the arithmetic formulae thresholds for the amount of the photoconductive member usage, and data (for the DC voltage of the charge bias, and the DC voltage of the development bias), are such values that match the properties of the cartridge to which the memory 30 is attached. Further, the set of data for one process speed is different in value from the set of data for another process speed. These sets of data are written into the memory during cartridge production.

Shown in Table 1 are the thresholds for the amount of the photoconductive member usage, and the data for specifying the processing condition.

TABLE 1

| DRUM USAGE | A (sec) | 0 | 450 (= Bj) | 1800 (= Bk) |
|---|---|---|---|---|
| PROCESS SPEED Va | CHRG. DC. BIAS DATA | Cai | Caj | Cak |
| | DEV. DC. BIAS DATA | Dai | Daj | Dak |
| PROCESS SPEED Vb | CHRG. DC. BIAS DATA | Cbi | Cbj | Cbk |
| | DEV. DC. BIAS DATA | Dbi | Dbj | Dbk |

The memory and the main assembly of the image forming apparatus are set up so that the data in the memory can be transmitted at any time from the memory to the arithmetic portion 43 of the controlling means 40 of the main assembly, and vice versa. Calculation is made based on these data, and the data are referenced by the controlling portion processor 41.

The length of time the AC voltage of the charge bias is applied, and the length of time the photoconductive member is rotated, are measured by the main assembly during a printing operation, and the amount by which the photoconductive drum 1 has been used during the image forming operation having just ended is calculated at the end of the rotation of the photoconductive drum 1. The values obtained through the calculation, are stored in the memory, replacing the old values.

The amount A of the photoconductive member usage can be expressed in the following arithmetic formulae:

$$A=\phi a\times(ta1+ka\times ta2)+\phi b\times(tb1+kb\times tb2)$$

ta1: length of time AC voltage of charge bias has been applied at process speed of Va;

ta2: length of time photoconductive member has been rotated at process speed of Va;

tb1: length of time AC voltage of charge bias has been applied at process speed of Vb; and tb2: length of time photoconductive member has been rotated at process speed of Vb.

Here, the values for substituting the coefficients ka, kb, ϕa, and ϕb are taken from Table 2, and the reason therefor will be described next.

TABLE 2

| | | |
|---|---|---|
| WEIGHT FOR PROCESS SPEED Va | øa | 1.0 |
| WEIGHT FOR PROCESS SPEED Vb | øb | 0.50 |
| WEIGHT OF ROT. TIME IN Va | ka | 0.40 |
| WEIGHT OF ROT. TIME IN Vb | kb | 0.20 |

The inventors of the present invention studied the effects of the length of time a photoconductive drum is driven, and the length of time the voltage is applied to a photoconductive member, upon the amount of photoconductive drum usage, more specifically, the amount by which a photoconductive drum is shaved, in the image forming apparatus in this embodiment, during an image formation sequence, finding that when the process speed was Va, the effect of the length of time of the application of AC voltage as a part of charge bias, upon the amount by which the photoconductive drum was shaved, was roughly two to three times the effect of the length of time of the rotation of the photoconductive drum, upon the amount by which the photoconductive drum was shaved.

While AC voltage is applied as a part of charge bias, the peripheral surface of a photoconductive member is rapidly alternated in polarity, causing electrical discharge to alternately occur in one direction and the reverse direction, and therefore, substantially deteriorating the peripheral surface of the photoconductive drum. The deteriorated portions of the peripheral surface of the photoconductive member are shaved away by the friction between the photoconductive member and the members, such as the cleaning blade, which are in contact with the photoconductive member.

In comparison, when the process speed was Vb, the effect of the length of time of the application of AC voltage as a part of charge bias, upon the amount by which the photoconductive drum was shaved, was roughly 4.0 to 6.0 times the effect of the length of time of the rotation of the photoconductive drum, upon the amount by which the photoconductive drum was shaved. The reason for this phenomenon may be presumed to be that when the process speed was Vb (half the process speed Va), the distance a given point of the peripheral surface of a photoconductive member moved per unit of time was half the distance a given point of the peripheral surface of the photoconductive member moved per unit of time when the process speed was Va, reducing thereby the frequency at which the given point of the peripheral surface of the photoconductive drum was rubbed by a cleaning blade and the like. Therefore, the amount by which the peripheral surface of the photoconductive drum is shaved when the process speed was Vb became roughly half the amount by which the peripheral surface of the photoconductive drum was shaved when the process speed was Va.

Described above are the results of the tests carried out by the inventors of the present invention, in which an organic photoconductive member, the main binder of the surface layer (photoconductive layer) of which was a mixture of acrylate and polycarbonate, and in which the photoconductive member was cleaned by a cleaning blade.

Figure 5:
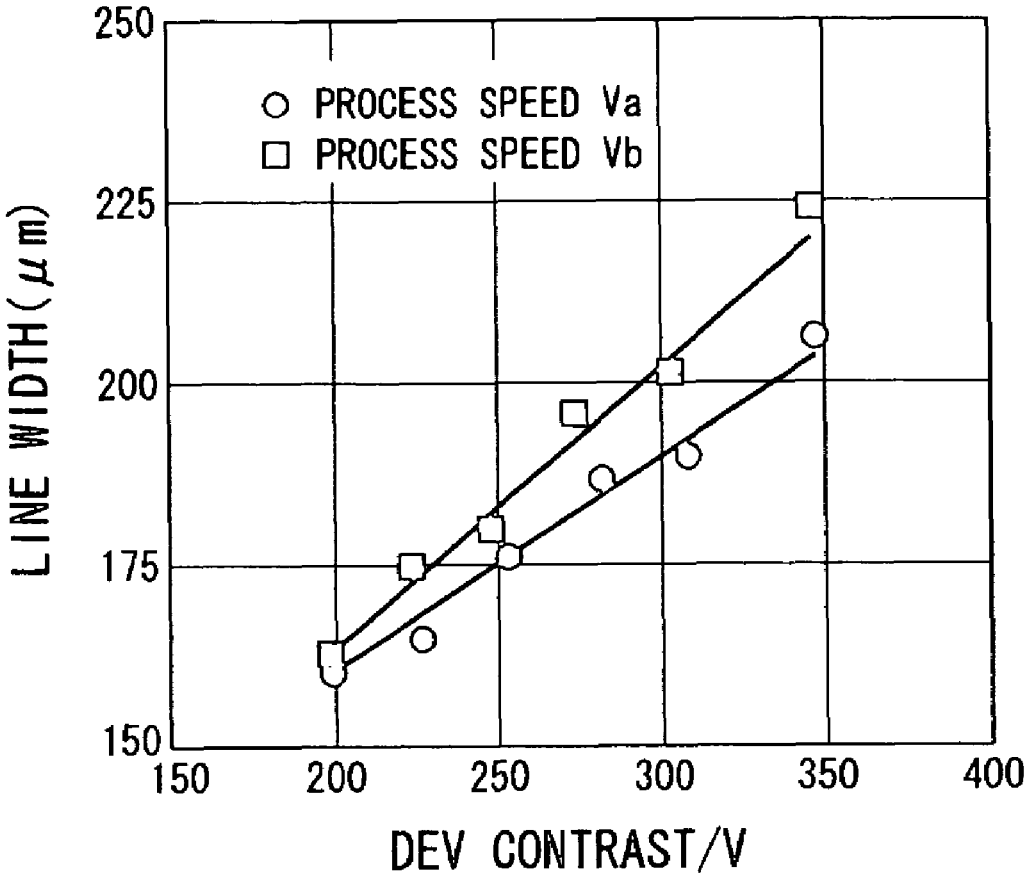
FIG. 5 is a graph showing the relationship between the development contrast and the line width, in the first embodiment of the present invention.

FIG. 5 shows the relationship between the contrast in potential level, and the line width. Here, the contrast in potential level means the absolute value of the difference between the potential level of the DC component of the development bias, and the potential level Vl of the peripheral surface of the photoconductive drum.

As will be evident from FIG. 5, the contrast and line width show a substantial degree of correlation; the amount of the change in line width per 10 V of DC component of the development bias is in the range of 2-5 (μm/10 V). Therefore, all that is necessary to compensate for the effect of the condition of the cartridge C upon the line width is to control the aforementioned contrast in potential level. In this embodiment, a method in which the DC component of the development bias, and the DC component of the charge bias, are changed, is used as a means for changing the contrast in potential level.

Next, referring to FIGS. 6-1, 6-2, and 6-3 which are flowcharts, the operation of the image forming apparatus in this embodiment will be described. The image forming apparatus in this embodiment is set up so that its process speed can be switched in accordance with the size of recording sheet. It is such an image forming apparatus that when a recording sheet of a size smaller than the normal size is used, the process speed is reduced to Vb (½Va) in order to prevent the problem that while the recording sheet of a smaller size passes through the fixing apparatus, the temperature of the fixation nip excessively increases across the ranges where the sheet does not pass.

The data, in the aforementioned flowcharts, for specifying the processing condition, and the values to which the processing condition is set in the aforementioned flowcharts, are shown in Table 3.

TABLE 3

| | DATA IN MEMORY | PROCESS CONDITION |
|---|---|---|
| CHRG. DC. BIAS DATA | Cai | −683 V |
| | Caj | −665 V |
| | Cak | −595 V |
| | Cbi | −623 V |
| | Cbj | −604 V |
| | Cbk | −585 V |
| DEV. DC. | Dai | −513 V |

TABLE 3-continued

| | DATA IN MEMORY | PROCESS CONDITION |
|---|---|---|
| BIAS DATA | Daj | −495 V |
| | Dak | −425 V |
| | Dbi | −453 V |
| | Dbj | −434 V |
| | Dbk | −415 V |

Next, the operation of the image forming apparatus in this embodiment, from when a print start signal is inputted to when the print corresponding to the print start signal comes out of the apparatus, will be described.

S101: A print start signal is inputted;

S102: The controlling portion 40 determines whether or not the width (length in terms of lengthwise direction of fixation roller) of the transfer medium 20 in the feeding cassette is greater than that of a sheet of "A4 size";

(1-1) Case 1: If it was determined in S102 that the width of the transfer medium 20 is no less than that of a sheet of "A4" size.

S103: The control portion 40 sets the process speed of the apparatus to "Va".

S104: The portion 44 for detecting the length of the charge bias application, and the portion 43 for detecting the length of the duration of the photoconductive member rotation, begin measuring the length of the charge bias application, and the length of the photoconductive member rotation.

S105: The control portion 40 receives the amount A of the drum usage from the memory.

S106: The control portion 40 determines whether or not the amount A is no more than Bj (A<Bj), and when the answer is "No", a step S110 is performed; Bj represents the threshold for the amount of the drum usage (FIG. 3).

S107: The control portion 40 receives "data Cai regarding the DC component of the charge bias", and "data Dai regarding the DC component of the development bias", and sends out signals for changing the DC component of the charge bias and the DC component of the development bias, to the control portion 61 for controlling the DC current from the development bias application power source, and the control portion 51 for controlling the DC current from the charge bias application power source.

S108: The level of the DC component of the development bias is set to −513 V.

S109: The level of the DC component of the charge bias is set to −683 V.

(1-2) Case 2: If the answer to (A<Bj) in S106 is "No",

S110: The control portion 40 determines whether or not the amount A is no more than Bk (A<Bk), and when the answer is "No", a step S114 is performed; Bk is the threshold for the amount of the drum usage (FIG. 3).

S111: The control portion 40 receives "data Caj regarding the DC component of the charge bias", and "data Daj regarding the DC component of the development bias", and sends out a signal for changing the DC component of the development bias, to the control portion 61 for controlling the DC current from the development bias application power source, and then, sends out a signal for changing the DC component of the charge bias, to the control portion 51 for controlling the DC current from the charge bias application power source.

S112: The level of the DC component of the development bias is set to −495V.

S113: The level of the DC component of the charge bias is set to −665 V.

(1-3) Case 3: If the answer to (A<Bk) in S110 is "No",

S114: The control portion 40 receives "data Cak regarding the DC component of the charge bias", and "data Dak regarding the DC component of the development bias", and sends out a signal for changing the DC component of the development bias, to the control portion 61 for controlling the DC current from the development bias application power source, and then, sends out a signal for changing the DC component of the charge bias, to the control portion 51 for controlling the DC current from the charge bias application power source.

S115: The level of the DC component of the development bias is set to −425 V.

S116: The level of the DC component of the charge bias is set to −595 V.

(1-4) Case 4: If it was determined in S102 that the width of the transfer medium 20 is no more than that of a sheet of "A4 size", S117: The control portion 40 sets the process speed of the apparatus to "Vb".

S118: The portion 43 for detecting the length of the duration of the photoconductive member rotation, and the portion 44 for detecting the length of the duration of the charge bias application, begin measuring the length of the duration of the photoconductive member rotation, and the length of the duration of the charge bias application.

S119: The control portion 40 receives the amount A of the drum usage from the memory.

S120: The control portion 40 determines whether or not the amount A is no more than Bj (A<Bj), and when the answer is "No", a step S124 is performed; Bj is the threshold for the amount of the drum usage (FIG. 3).

S121: The control portion 40 receives "data Cbi regarding the DC component of the charge bias", and "data Dbi regarding the DC component of the development bias", and sends out a signal for changing the DC component of the development bias, to the control portion 61 for controlling the DC current from the development bias application power source, and then, sends out a signal for changing the DC component of the charge bias, to the control portion 51 for controlling the DC current from the charge bias application power source.

S122: The level of the DC component of the development bias is set to −453 V.

S123: The level of the DC component of the charge bias is set to −623 V.

(1-5) Case 5: If the answer to (A<Bj) in S120 is "No",

S124: The control portion 40 determines whether or not the amount A is no more than Bk (A<Bk), and when the answer is "No", a step S128 is performed; Bk is the threshold for the amount of the drum usage (FIG. 3).

S125: The control portion 40 receives "data Cbj regarding the DC component of the charge bias", and "data Dbj regarding the DC component of the development bias", and sends out a signal for changing the DC component of the development bias, to the control portion 61 for controlling the DC current from the development bias application power source, and then, sends out a signal for changing the DC component of the charge bias, to the control portion 51 for controlling the DC current from the charge bias application power source.

S126: The level of the DC component of the development bias is set to −434 V.

S127: The level of the DC component of the charge bias is set to −604 V.

(1-6) Case 6: If the answer to (A<Bk) in S124 is "No",

S128: The control portion 40 receives "data Cbk regarding the DC component of the charge bias", and "data Dbk regarding the DC component of the development bias", and sends a switching signal to the control portion 61 for controlling the DC current from the development bias application power source, and then, sends out a switching signal to the control portion 51 for controlling the DC current from the charge bias application power source.

S129: The level of the DC component of the development bias is set to −415 V.

S130: The level of the DC component of the charge bias is set to −585 V.

S131: The actual image forming operation is started.

S132: The actual image forming operation ends.

S133: The control portion 40 calculates the amount A, reflective of weighting factors, of the photoconductive drum usage by adding the length of time of the application of the AC component of the charge bias to the length of the duration of the photoconductive member rotation, while weighting the length of the photoconductive member rotation by coefficients (ka and kb) and also, weighting the sum by coefficients (ϕa and ϕb) which reflect the difference in process speed. Then, the sum of (A+ΔA) is written, as the cumulative amount of the drum usage, by the writing means into the memory, ending the control sequence (END).

The changes in the line width which occurred while the above described control was carried out is represented by the single-dot chain line in FIG. 3.

It is evident from this line in FIG. 3 that the line width remained within a range of 180-200 μm, that is, a proper range. This proves that this embodiment keeps an image forming apparatus stable in terms of image quality.

As described above, according to this embodiment of the present invention, prior to the starting of the actual image forming operation, not only are the DC component of the charge bias, and the DC component of the development bias, adjusted according to process speed, but also, the cumulative amount of the usage of the photoconductive drum in a given process cartridge is compared with specific thresholds which reflect the properties of the photoconductive drum, and if the cumulative amount of the usage of the photoconductive drum had reached or exceeded one of the thresholds, the DC component of the charge bias, and the DC component of the development bias, are rectified in potential level, based on a table prepared in accordance with the properties of the process cartridge. Therefore, this embodiment can stabilize an image forming apparatus in terms of line width.

Further, instead of multiple values corresponding, one for one, to multiple process speeds, a single value obtained by weighting the measured amount of photoconductive drum usage with process speed is stored as the amount of photoconductive drum usage, sparing thereby storage regions.

In this embodiment, two thresholds are provided for the drum usage data. However, three or more thresholds may be provided, depending on the structural characteristics, so that the processing condition can be more precisely adjusted.

Also in this embodiment, in order to change the processing condition, the charge and development voltages are changed. In some cases, however, the frequency of the development bias, and/or amount of exposure, may be changed. Further, data calculated from an arithmetic formulae is used as the drum usage data. However, the print count or the length of the duration of photoconductive member rotation alone may be used as the drum usage data.

Embodiment 2

Figure 7:
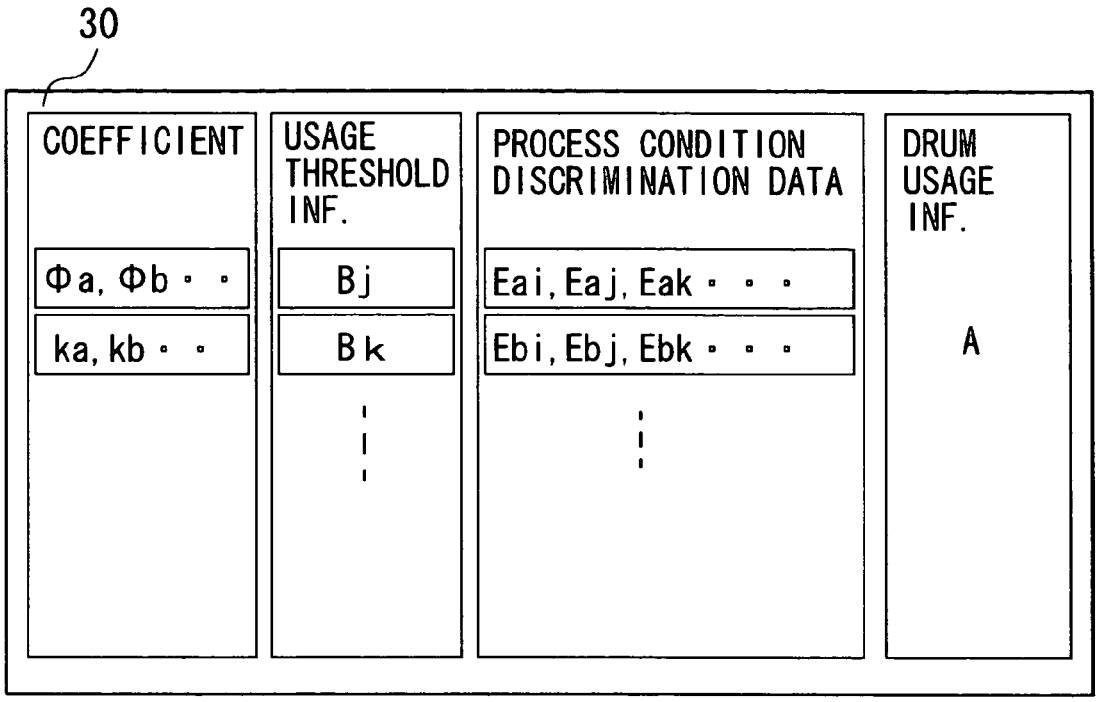
FIG. 7 is a block diagram showing the structure of the storage region in the memory in the second embodiment of the present invention.

In this embodiment, instead of separately storing in the memory, a set of data for specifying the level of the DC component of the charge bias, and a set of data for specifying the level of the DC component of the development bias, the two sets of data are combined and are stored as a single set of data. FIG. 7 shows the storage regions of the memory in this embodiment. Reference symbols Eai, Eaj, Eak, Ebi, Ebj, and Ebk represent multiple sets of combination data, one for one. Thus, as the controlling means receives one of these sets of combination data, it transmits control signals to both the control portion for controlling the power source for applying the DC component of the charge bias, and to the controlling portion for controlling the power source for applying the DC component of the development bias.

In combining the data for specifying the level of the DC component of the charge bias, with the data for specifying the level of the DC component of the development bias, they must be combined so that the development contrast can be changed while keeping the back contrast roughly constant in order to prevent fog formation.

Table 4 shows the combination data, values for the DC component of the charge bias, corresponding to the combination data, and values for the DC component of the development bias, corresponding to the combination data.

TABLE 4

| | DATA IN MEMORY | CHRG. DC. BIAS | DEV. DC. BIAS |
|---|---|---|---|
| COMBINED DATA OF CHRG. DC. BIAS & DEV. DC. BIAS | Eai | −683 V | −513 V |
| | Eaj | −665 V | −495 V |
| | Eak | −595 V | −425 V |
| | Ebi | −623 V | −453 V |
| | Ebj | −604 V | −434 V |
| | Ebk | −585 V | −415 V |

With the above described provision, not only can the effects of the first embodiment be realized, but also, multiple processing units can be controlled per set of data, in the memory, for specifying the processing condition, sparing thereby the storage regions.

The data for specifying the processing condition, in the preceding embodiments, may be such data that are used in conjunction with the data in the density adjustment table with which the main assembly of an image forming apparatus is provided to allow a user to adjust the density. In such a case, the data to be stored in the memory are such data that are usable for setting the density level to one of the values in the density adjustment table with which the main assembly is provided.

Further, the data to be used for changing the processing condition do not need to be the combinations of only the DC component of the charge bias and the DC component of the development bias. In other words, they may be combinations among the DC component of the charge bias, the DC component of the development bias, the amount of exposure, etc.

As will be evident from the description of the embodiments of the present invention, according to the present invention, it is possible to compensate for the changes in operational condition resulting from cartridge usage, in order to keep an image forming apparatus stable in image quality. Therefore, it is possible to always form an image of preferable quality.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus to which a process cartridge is mountable and which is operable to form images at a first image formation speed and a second image forming speed, wherein the process cartridge includes a process device and a memory medium configured to store information relating to image forming conditions of the process device, said image forming apparatus comprising:

a calculation portion configured calculate a use amount of the process cartridge;

a control unit configured to set the image forming conditions of the process device based on the use amount of the process cartridge and information stored in the memory medium, wherein the memory medium has a first memory area configured to store first information relating to image forming conditions of the process device corresponding to the first image formation speed and a second memory area configured to store second information relating to image forming conditions of the process device corresponding to the second image formation speed, wherein when said image forming apparatus operates at the first image formation speed, and an amount of use of said process cartridge reaches a predetermined threshold value, said control unit sets image forming conditions of the process device to first image conditions on the basis of the first information stored in the first memory area of the memory medium, and wherein when said image forming apparatus operates at the second image formation speed, and an amount of use of said process cartridge reaches the predetermined threshold value, said control unit sets image forming conditions of the process device to second image conditions different from the first image conditions on the basis of the second information stored in the second memory area of the memory medium.

2. An image forming apparatus according to claim 1, wherein the process device includes at least an image bearing member, wherein the image formation speeds are rotational speeds of the image bearing member.

3. An image forming apparatus according to claim 1, wherein the memory medium further includes a third memory area configured to store information relating the use amount of the cartridge.

4. An image forming apparatus according to claim 3, wherein the memory medium further includes a fourth memory area configured to store information relating to the predetermined threshold value.

5. An image forming apparatus according to claim 4, wherein said control unit switches an image forming condition of the image forming conditions when the use amount of an image bearing member reaches the predetermined threshold value.

6. An image forming apparatus according to claim 1, wherein the process device includes an image bearing member, a charging member configured and positioned to electrically charge the image bearing member, and a developing member configured and positioned to develop a latent image formed on the image bearing member, and wherein the image forming conditions include a bias voltage to be applied to the charging member and the developing member.

7. A process cartridge detachably mountable to a main assembly of an image forming apparatus which is operable to form images at a first image formation speed and a second image formation speed, said process cartridge comprising:

a process device configured and positioned to perform an image forming operation; and a memory medium, wherein said memory medium has a first memory area configured to store first information relating to image forming conditions of said process device corresponding to the first image formation speed, the first information being for setting image forming conditions of said process device to first image forming conditions when the image forming apparatus forms an image at the first image formation speed, and an amount of use of said process cartridge reaches a predetermined threshold value, and wherein said memory medium has a second memory area configured to store second information relating to image forming conditions of said process device corresponding to the second image formation speed, the second information being for setting image forming conditions of the process device to second image forming condition different from the first image forming conditions when the image forming apparatus forms an image at the second image formation speed, and an amount of use of said process cartridge reaches the predetermined threshold value.

8. A process cartridge according to claim 7, wherein said memory medium further includes a third memory area configured to store information relating to the use amount of said process cartridge.

9. A process cartridge according to claim 7, wherein said memory medium further includes a fourth memory area configured to store information relating to the predetermined threshold value.

10. A process cartridge according to claim 7, wherein said process device includes at least an image bearing member, wherein the image formation speeds are rotation speeds of said image bearing member.

11. A process cartridge according to claim 7, wherein said process device includes an image bearing member, a charging member configured and positioned to for electrically charge said image bearing member, and a developing member configured and positioned to develop a latent image formed on said image bearing member, wherein the image forming conditions include a bias voltage to be applied to said charging member and said developing member.

12. A process cartridge according to claim 7, wherein said memory medium further includes a third memory area configured to store information relating to a coefficient to be used for calculation of the use amount of the process cartridge.

* * * * *

UNITED STATES PATENT AND TRADEMARK OFFICE

CERTIFICATE OF CORRECTION

PATENT NO. : 7,274,884 B2
APPLICATION NO. : 10/702658
DATED : September 25, 2007
INVENTOR(S) : Kazumi Yamauchi It is certified that error appears in the above-identified patent and that said Letters Patent is hereby corrected as shown below:

COLUMN 2
Line 50, “the” should read --of the--.

COLUMN 3
Line 7, “and;” should read --and--.

Figure 6A:
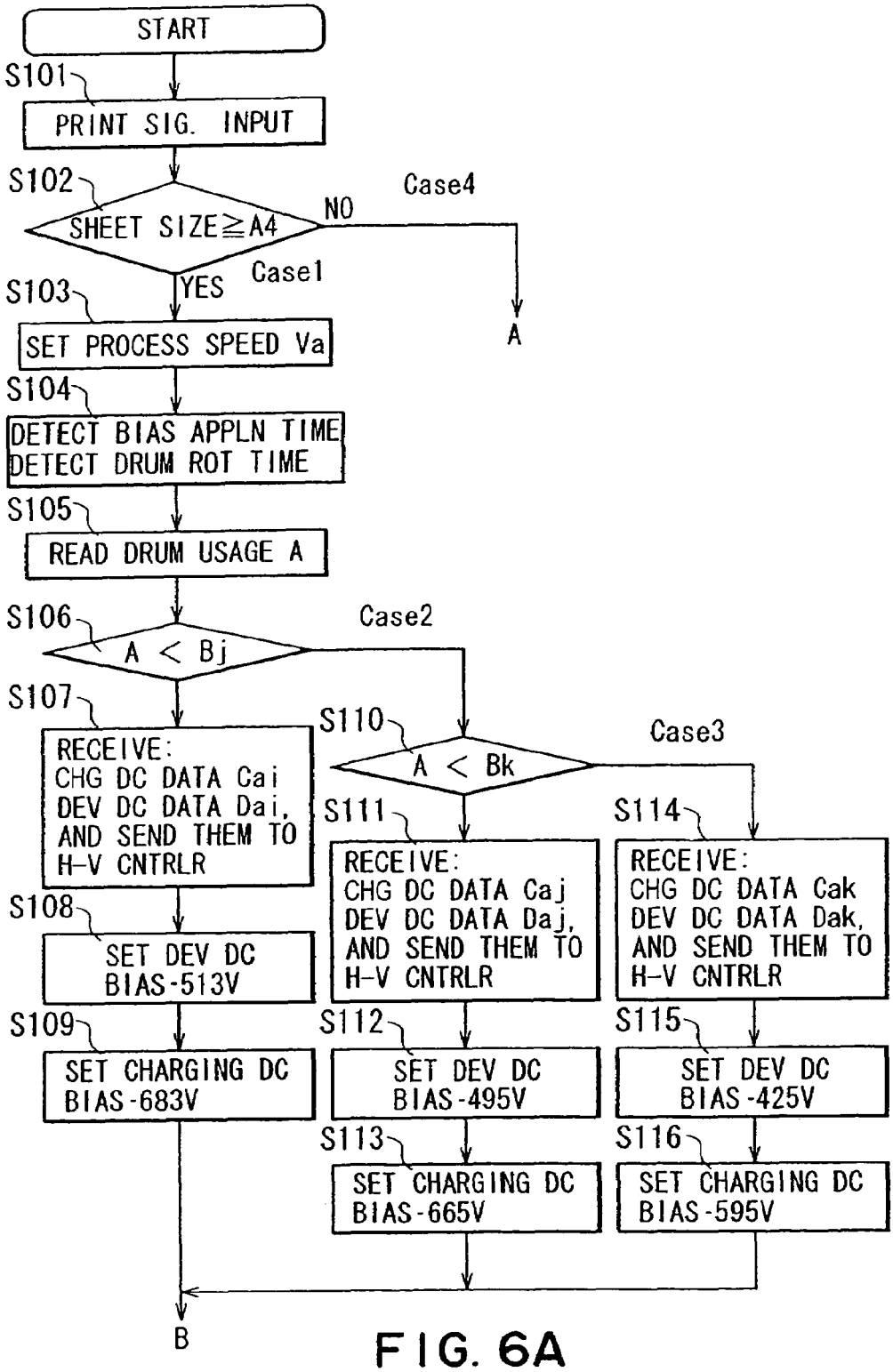
FIG. 6A is a part of the flowchart showing the operation of the image forming apparatus in the first embodiment of the present invention.
Figure 6B:
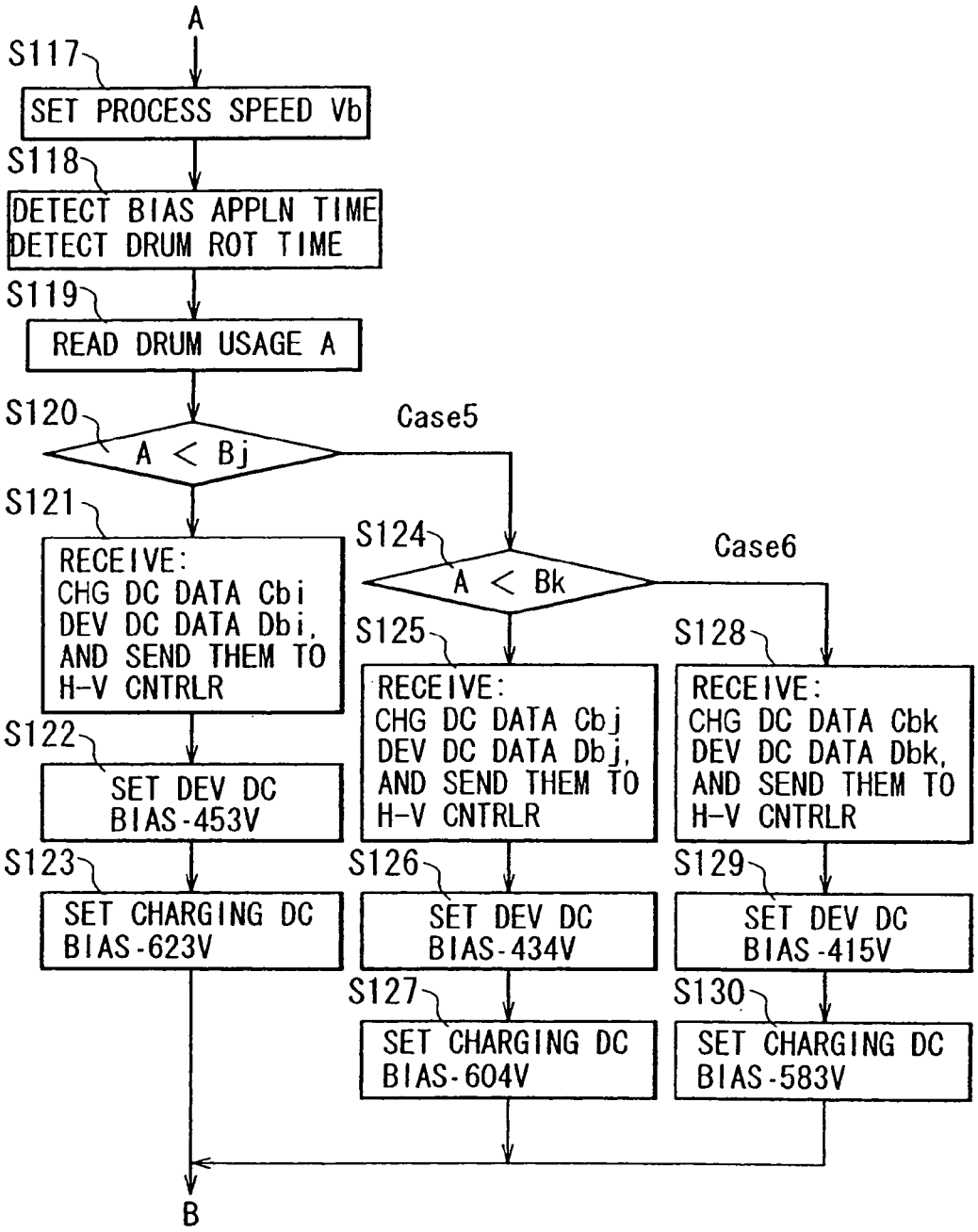
FIG. 6B is another part of the flowchart showing the operation of the image forming apparatus in the first embodiment of the present invention.
Figure 6C:
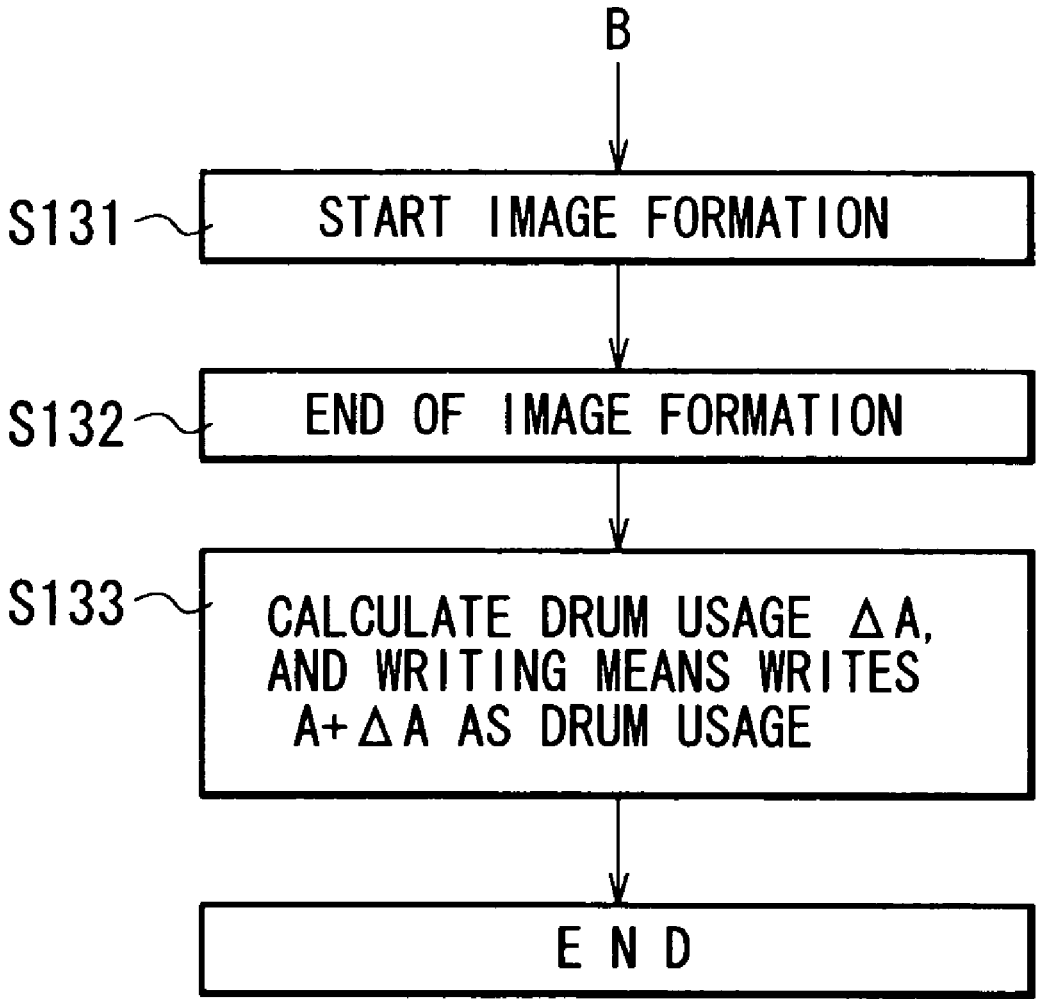
FIG. 6C is a flowchart showing the operation of the image forming apparatus in the first embodiment of the present invention.

COLUMN 12
Line 41, “FIGS. 6-1, 6-2, and 6-3” should read --FIGS. 6A, 6B, and 6C--.

Signed and Sealed this

Sixth Day of January, 2009

JON W. DUDAS
*Director of the United States Patent and Trademark Office*